United States Patent [19]

Lesch

[11] Patent Number: 4,670,279

[45] Date of Patent: Jun. 2, 1987

[54] METHOD FOR WRAPPING ESSENTIALLY FLAT PRODUCTS OF THE LUXURY-ITEM OR FOODSTUFFS INDUSTRY, ESPECIALLY SQUARES OR BARS OF CHOCOLATE, IN PACKAGING FOIL

[75] Inventor: Hans Lesch, Garmisch-Partenkirchen, Fed. Rep. of Germany

[73] Assignee: Otto Hänsel GmbH, Hanover, Fed. Rep. of Germany

[21] Appl. No.: 599,609

[22] PCT Filed: Aug. 3, 1983

[86] PCT No.: PCT/EP83/00206

§ 371 Date: Apr. 3, 1984

§ 102(e) Date: Apr. 3, 1984

[87] PCT Pub. No.: WO80/00735

PCT Pub. Date: Mar. 1, 1984

[30] Foreign Application Priority Data

Aug. 13, 1982 [DE] Fed. Rep. of Germany ..... 3230083

[51] Int. Cl.[4] ..... B65B 11/06

[52] U.S. Cl. ..... 426/410; 53/450; 53/550

[58] Field of Search ..... 53/450, 550, 568, 209; 426/410

[56] References Cited

U.S. PATENT DOCUMENTS

| | | | |
|---|---|---|---|
| 2,049,756 | 8/1936 | Asmussen et al. | 53/450 |
| 2,484,780 | 10/1949 | Clunan | 53/450 |
| 2,605,597 | 8/1952 | Scheib | 53/550 |
| 2,959,901 | 11/1960 | Conti | 53/450 |
| 3,001,340 | 9/1961 | Gosman | 53/450 |
| 3,009,298 | 11/1961 | Gerlach et al. | 53/450 |
| 3,024,581 | 3/1962 | Cloud | 53/450 |
| 3,090,174 | 5/1963 | Kraft | 53/450 |
| 3,189,505 | 6/1965 | Sloan et al. | 53/450 |
| 3,229,442 | 1/1966 | Gram | 53/450 |
| 3,295,290 | 1/1967 | Billingsley et al. | 53/450 |
| 3,303,630 | 2/1967 | Harm | 53/450 |
| 3,338,021 | 8/1967 | Liedtke | 53/450 |
| 3,402,524 | 9/1968 | Griner | 53/542 |
| 3,589,091 | 6/1971 | Cloud | 53/450 |
| 3,807,117 | 4/1974 | Abrams | 53/450 |
| 3,908,333 | 9/1975 | Cavanna | 53/209 |
| 4,035,984 | 7/1977 | Gerlach et al. | 53/550 |

FOREIGN PATENT DOCUMENTS

| | | | |
|---|---|---|---|
| 2034748 | 3/1971 | Fed. Rep. of Germany . | |
| 739808 | 11/1955 | United Kingdom | 53/450 |

*Primary Examiner*—Steven Weinstein
*Attorney, Agent, or Firm*—Max Fogiel

[57] ABSTRACT

Methods and devices for wrapping essentially flat products of the luxury-comestibles or foodstuffs industry, especially squares or bars of chocolate, in packaging foil or film. The object is tubular packaging, especially the inner wrapping of squares or bars of chocolate at high machine output without especially stressing the particular packaging foil while maintaining a low level of packaging-material consumption. This is attained in that the webs of foil are transported by means of an intermittently direct connection between foil web and pushers.

3 Claims, 11 Drawing Figures

METHOD FOR WRAPPING ESSENTIALLY FLAT PRODUCTS OF THE LUXURY-ITEM OR FOODSTUFFS INDUSTRY, ESPECIALLY SQUARES OR BARS OF CHOCOLATE, IN PACKAGING FOIL

The invention concerns a method of wrapping essentially flat products of the luxury-comestibles or foodstuffs industry, especially squares or bars of chocolate, in packaging foil or film and simultaneously discloses a device for carrying out the method. Machines called tubular machines, in which packaging film runs from a supply roll in the form of a web to which the pieces to be wrapped are conveyed one following another at an interval by pushers resting on a transport traveling in the same direction as the web of film, subsequent to which the film is wrapped around each individual piece and sealed at its longitudinal and transverse edges, have been employed up to now to package all types of packaged goods. The plastic films employed in this process must be especially rugged and pliable because they have to be drawn over shaping tools of the widest range of types during the operation. Considerable wrapping-material overlap must be provided in order to make the package conform with the requisite tightness standards. This leads to high material consumption and low machine output. Very thin aluminum foil, which is especially amenable to heat-sealing can hardly be employed. Still, metal foils of this type are just the materials that are particularly intended for packaging candy, especially squares or bars of chocolate.

The object of the present invention is to eliminate the aforesaid drawback and create a method and device that allow tubular packaging to be carried out, especially for the inner wrapping of flat articles like squares or bars of chocolate, without specially stressing the particular packaging foil and simultaneously reducing the consumption of packaging material.

Packages in which a longitudinal seam is produced at the narrow end are intended in particular to be manufactured and foils, especially thin metal foils amenable to heat sealing, that are not processed over the type of shaping shoulder ordinarily used in conventional tubular machines are employed, ensuring seams that are particularly tight.

This object is obtained in accordance with the invention in that the webs of foil are transported by means of an intermittently direct connection between foil web and pushers. The web of foil is preferably transported intermittently secured by the pushers that advance the pieces to be wrapped. The web of packaging foil, especially aluminum foil, is in accordance with the invention longitudinally shaped into a tube of wrapping material that has a U-shaped cross-section, that is open at one side, and that accommodates the pieces to be wrapped. The tube is grasped and entrained by conveyor belts rotating at about the same speed because at least one of two arms of the U-shaped tube of foil around the products and the pushers positioned between them is tensioned between and carried along by the pushers and pressure elements that act on the conveyor bands and travel along with them.

A special advantage is that the packaging foil, especially aluminum foil, is pulled off at the instant the products are supplied from where they are stored and is wrapped flat around the series of products in the shape of a U.

The device for carrying out the method just described is characterized by a tube former that forms the web of foil leaving the roll into a tube of foil with a U-shaped cross-section open at the side and extending around the products and that is located downstream of the point at which the products to be wrapped enter the system and of the point at which the web of foil flows into the system, with the transport, traveling along beside the tube of foil, having, first, pushers that project laterally into the opening in the tube and, second, a pressure device on at least on side of the tube of foil that travels along at the same speed as the pushers and presses one side of the tube against them.

A particular advantage is that the tube former operates in conjunction with a pair of conveyor belts that grasps the tube of foil with a U-shaped cross-section on both sides, with a pressure device traveling along on each side of the tube and, subject to spring force, pressing the side of the conveyor belt that rests against the tube of foil against the pushers that project between the arms of the U-shaped tube as they travel along.

The tube of foil is conveyed in the form of a collapsed U, with the pair of conveyor belts consisting of a belt that carries the tube and of a supporting belt resting on the top of the tube. It is practical that both the pusher transport and the pair of conveyor belts have a geared drive, ensuring satisfactory conveyance of the freely running web and the tube of foil formed out of it.

Downstream of the tube former, finally, are tools for sealing or welding and for folding the laterally projecting edges of the foil as well as a transverse sealing station and a separating device for separating the products from the tube once they have been individually wrapped in the aluminum foil and sealed on all sides.

The theory behind the invention can be applied to a very wide range of possible embodiments. A device for carrying out the method in accordance with the invention will now be described with reference to the attached drawings, in which

BRIEF DESCRIPTION OF THE DRAWINGS

FIG. 3, and FIGS. 4 through 9 are sections along the lines A–B through M–N in FIG. 3.

Figure 1:
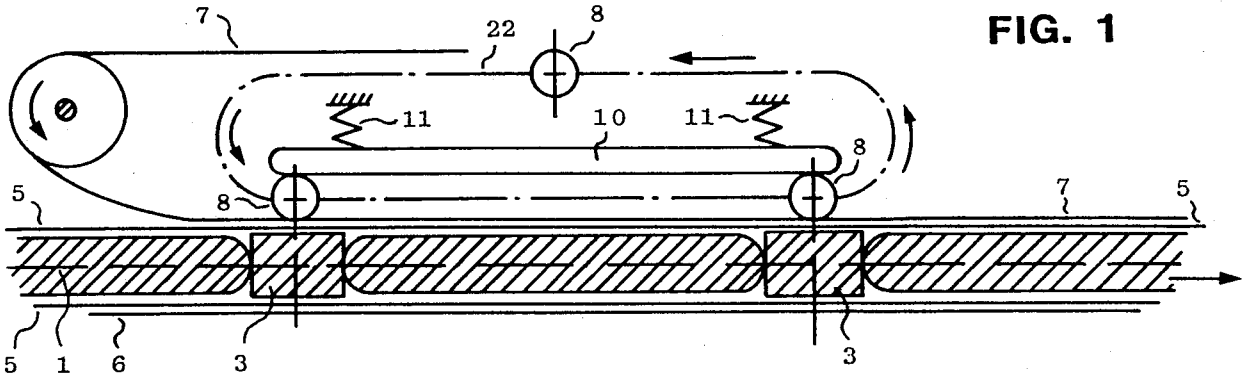
FIGS. 1 and 2 are schematic drawings illustrating the problem solved in accordance with the invention.

The products 1 to be packaged, especially confections like squares or bars of chocolate etc., are conveyed by a belt 2 as they arrive from the manufacturing device. Any other preferably flat products of the foodstuffs or tobacco industry etc. can naturally also be packaged by the same method.

The conveyance of products 1 on supply belt 2 is assisted by pushers 3 positioned, one behind another and at an interval equal to the length of the products, on a gear-driven transport operating at the same speed. Pusher transport 3*a* runs next to the conveyor belt, with pushers 3 secured in such a way that they can be laterally displaced in pusher mounts 3*b* on transport 3. The laterally displaceable pushers 3 extend in all cases over the total width of products 1 and travel alongside and at the same speed as belt 2.

The packaging foil or film, a heat-sealing aluminum foil 5 in the present case, is withdrawn from a supply roll 4 by means of a conveyor device that will be described later herein. The web of foil enters a tube former and is wrapped in the form of a collapsed U around products 1 as they arrive separated by an interval on belt 2. There is no need for separate forming aggregates.

Figure 5:
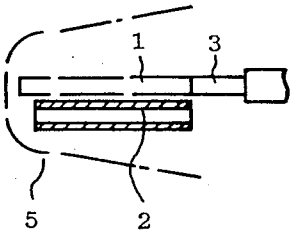

Products 1 are maintained by pushers 3 at the interval necessary for subsequent sealing. Products 1 and aluminum foil 5 are advanced at the same speed. Products 1 are inserted into the tube of foil, which has a U-shaped cross-section, as illustrated in FIG. 5. The tube of aluminum foil 5 is introduced with products 1 enclosed in it between a pair of conveyor belts 6 and 7 that rotate in the direction indicated by the arrow and consist of a lower carrier belt 6 and of a supporting belt 7 that rest on the top of the tube of aluminum foil 5.

The belt is guided as it enters by means of guide cylinders 21. Upper guide cylinder 21, which operates in conjunction with supporting belt 7, is subjected to the force of springs 21*a*.

Figure 6:
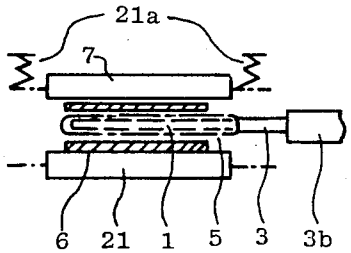
Figure 7:
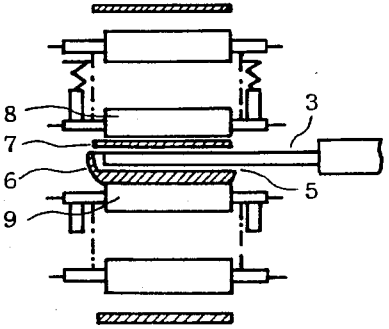
Figure 3C:
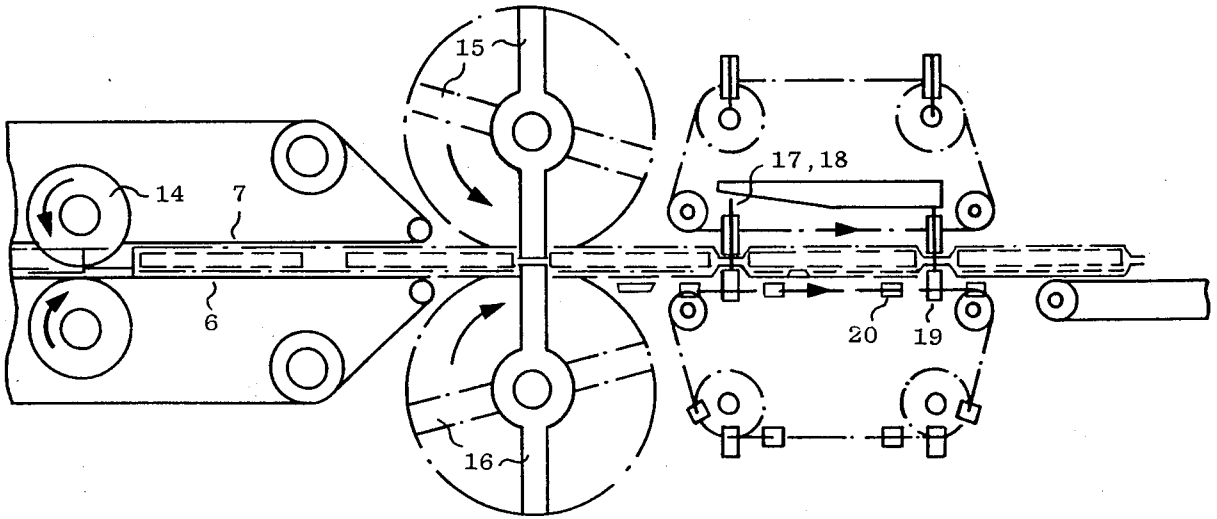

As will be evident form FIGS. 6 and 7, pushers 3 project into the U-shaped cross-section of the tube of aluminum foil 5 and completely cover the products 1 being conveyed.

Figure 2:
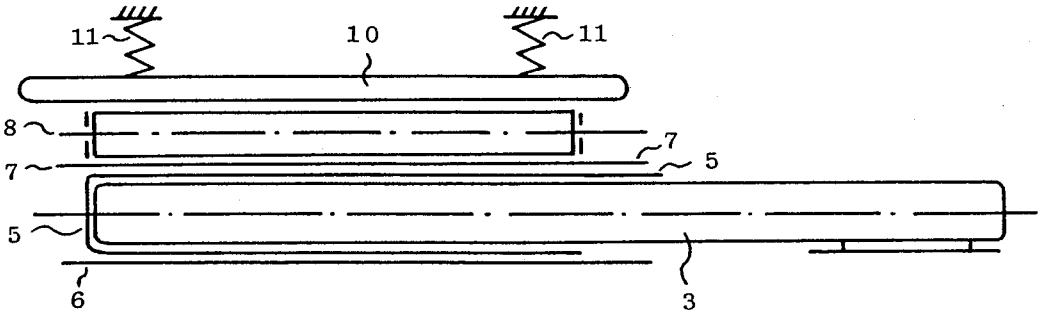
Figure 3A:
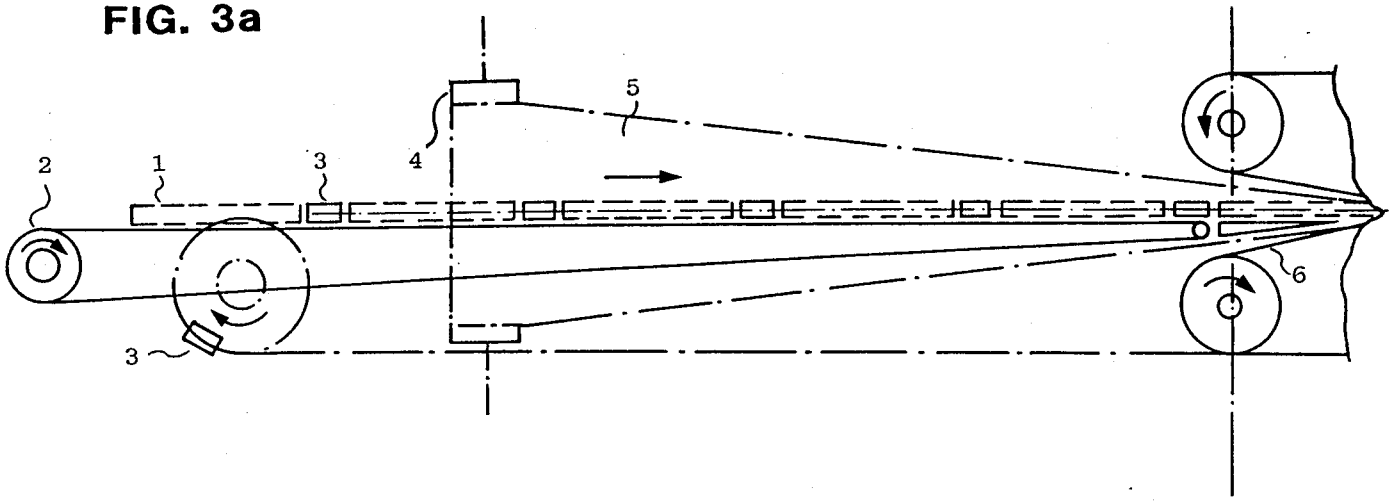
FIGS. 3*a* through 3*c* are a schematic side view of a device that carries out the method in accordance with the invention, the sequence 3*a* through 3*b* constituting a single illustration hereinafter designated

The tube of aluminum foil 5 is transported synchronized with pushers 3 assisted by a pressure device 8, 9, 10, 11, and 22. How the pressure device functions will be evident from FIGS. 1 and 2, although these figures illustrate only the device that operates on top, in conjunction with supporting belt 7 that is. The design of the pressure device that operates at the bottom in conjunction with carrier belt 6 is similar. The devices consist at any rate of a transport 22 in the form of a chain or belt equipped with pressure rollers 8 or 9. Inside transport 22 is a pressure rail 10 that is subject to the force of springs 11. Pressure rollers 8 travel along pressure rail 10 at an interval equal to that between pushers 3. As they travel along pressure rail 10, pressure rollers 8 or 9 are pressed tight against pushers 3 so that the side of supporting belt 7 or carrier belt 6 that rests against tube of aluminum foil 5 is pressed along with the associated side of the tube against the pushers and clamped by them. The gear-driven pushers 3 can accordingly entrain the tube of foil and the components that constitute the pressure device. Since aluminum foil 5 is stressed only slightly as it is removed from the roll by the flat clamping just described, extremely thin foils can be employed.

Furthermore, the extent to which the edge of the foil overlaps products 1 can be kept down to exactly what is needed for the subsequent sealing. This ensures minimal consumption of wrapping material.

The edges of the tube of aluminum foil 5 that extend beyond products 1 are now welded or sealed together by heated cylinders. Cylinders 12, 14, and 13 are mounted in such a way that they can be swung out of the way and can when necessary be completely retracted from the vicinity of products 1, which are sensitive to heat, so that no radiation will strike them. The cylinders are always, as will be evident from the figures, in pairs, with pairs 13 and 14 of cooling cylinders, which produce an optimally tight sealing seam at the most economical level of material consumption possible, positioned downstream of heating-cylinder pair 12, which does the sealing.

The heating cylinders and cooling cylinders are of course connected to heating and cooling devices that are in themselves known and accordingly not described in detail.

Figure 4:
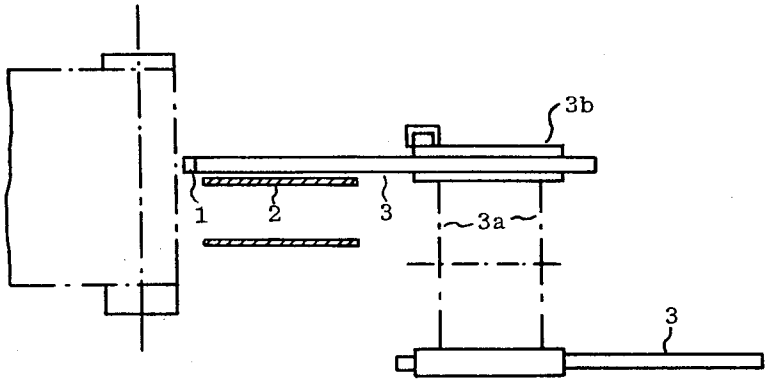
Figure 3B:
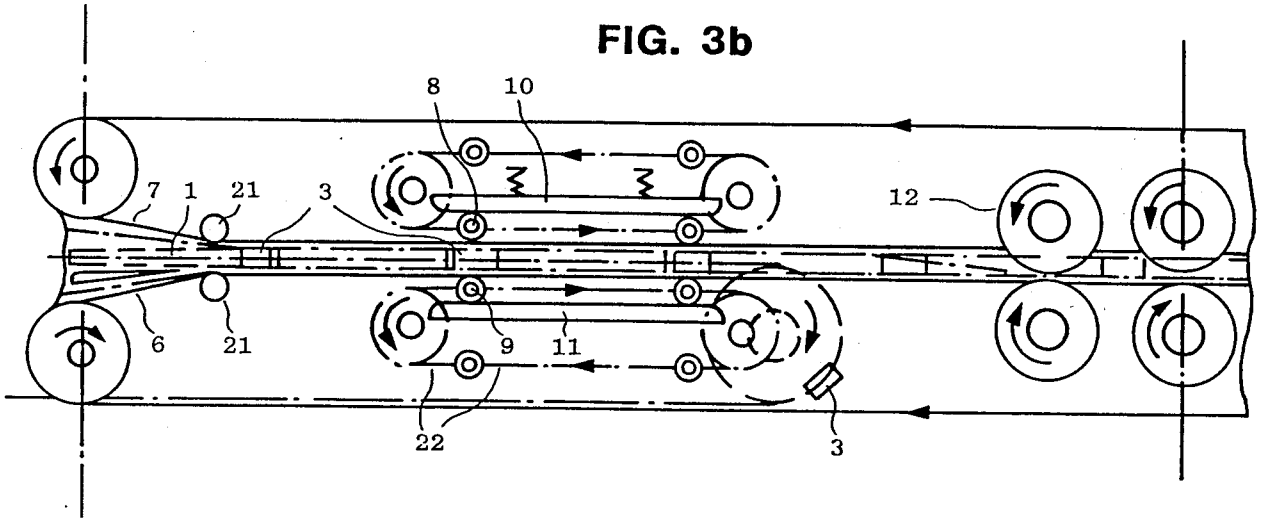
Figure 9:
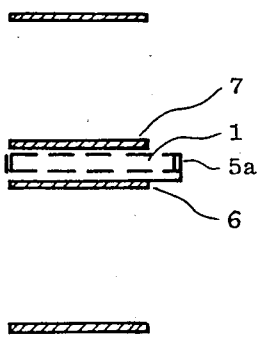
Figure 8:
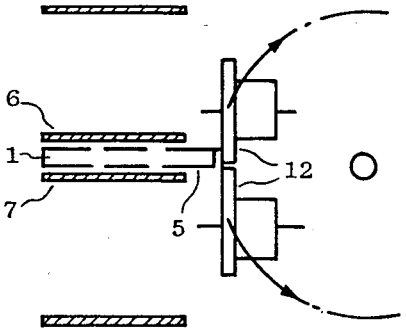

The tube of aluminum foil 5 is precisely introduced with the divided products 1 inside it between carrier belt 6 and supporting belt 7 for sealing. A longitudinal sealing seam is applied to the top or bottom as necessary by means of appropriate fold deflectors. The tube is again advanced at this stage along with products 1 by carrier belt 6 and supporting belt 7. The pushers 3 that advance products 1 and aluminum foil 5 have naturally already been extracted from the side of the tube before it is sealed as illustrated in FIG. 4.

Products 1 are finally conveyed positioned at a precise interval inside the tube of aluminum foil 5 to a transverse sealing station where rotating sealers 15 and 16 press the tube together and heat-seal it. Immediately thereafter the packages travel between cooling jaws 17 and 18, which grasp the tube in the vicinity of the transverse seam and press it together as it travels by. Only then are the individual products, tightly sealed into the packaging material on all sides, separated from each other by known methods.

The method describe herein and the device that carries it out can be employed for all types of packages, especially of course for products that are temperture-sensitive and must be packaged accordingly. This is especially true for the packaging of foodstuffs and luxury comestibles, especially chocolate and other confections, but also of tobacco products and other products not belonging to the class of foodstuffs and luxury comestibles.

In describing the tubular bag machine of the present invention in further detail, such tubular bag machines are well known in the packaging industry, and are known for their high packing efficiencies. Different features of such known tubular bag machines are included in applicant's invention. In particular, there is the U-shaped tubular packaging material 5. The arrangement of this tubular member may be viewed particularly in FIG. 5, where it is denoted by the reference numeral 5.

Conventional tubular bag machines, however, have had the disadvantage heretofore that aluminum foil cannot be used as packaging material. This results from the condition that aluminum foil can be easily torn and that it has low elasticity. In addition thereto, aluminum foil cannot be drawn over fixed or solid metal parts. Furthermore when these metal parts have a smooth surface, the aluminum foil will weld at points, from time to time, as a result of friction or rubbing. Such welding conditions lead to tearing of the foil when it continues to be transported.

In applicant's machine, care has been taken that the aluminum foil does not run over fixed or stationary parts, and a separate drive is provided for this purpose. This drive provides a minimum loading for the foil.

The U-shaped tubular foil 5 which lies on a side lies with full surface on a conveyor band 6 which runs with uniform velocity.

The articles 1 which are to be packaged are brought to the tubular foil 5 by the conveyor band 2. This conveyor band 2 runs with the same velocity as the tubular foil 5, as well as the conveyor band 6. For purposes of transporting the articles 1, the pushers 3 are not necessary. These pushers 3 operate with the same velocity as the conveyor band 2, the conveyor band 6, and the tubular foil 5. The elements 3 serve as means for maintaining spacing on the conveyor band 2. As a side-effect, these elements 3 make it possible that several loose parts may be packaged into one bag.

The main object of the pushers 3 is to provide for the driving of the tubular foil 5.

The function of the pusher arrangement may be further explained as follows:

In order to protect also the upper side of the tubular foil 5, there is provided a conveyor band 7 which runs also with the same velocity. The tubular foil 5 becomes thereupon pressed against the pushers 3 by being brought between the conveyor bands 6 and 7 and driving elements 8 and 9 which operate at the same velocity. The tubular foil 5 upon being pressed against the pushers 3 is clamped firmly in place. With this arrangement, there is achieved that slippage is prevented between the tubular foil 5 and the conveyor bands 6 and 7. Also prevented thereby are the uncontrollable tensile forces which can lead to the tearing of the relatively inelastic aluminum foil. As a result of the conveyor bands 6 and 7, there is assurance that the tubular foil does not slide over stationary parts.

In conjunction with the driving arrangement, the pushers 3 are drawn sidewise out of the tubular foil, so that it can become closed in the following arrangements 12 and 15. The transporting of the tubular foil with the articles lying therein is not accomplished by the apparatus 12 and 15. The hot sealing of the tubular foil is possible, for example, when the foil has at least one interior side covered with a thin coating of plastics.

I claim:

1. A method of wrapping substantially flat food articles, comprising the steps of: supplying packaging sheet material at a rate from a supply roll in form of a web; conveying said articles to be wrapped to said web at a rate substantially equal to the rate of movement of said web; conveying pushers associated with said food articles at substantially the same rate as said food articles; arranging said pushers at predetermined spacing between them, said pushers having a predetermined length for maintaining an interval between articles sufficient for subsequent sealing, said pushers having substantially the same height as said flat food articles; transporting said pushers and food articles alternately along a path and simultaneously shaping said web continuously into a longitudinal tube having an open side around said pushers and food articles; placing driving elements synchronized with movement of said pushers on the outer side of the tube for clamping said tube at its upper side and simultaneously at its bottom side between a pusher and a corresponding driving element without contacting articles between pushers, said web being transported by intermittent direct connection between pusher and corresponding driving element; removing the pushers from said tube; and sealing said tube to form packages, whereby delicately sensitive articles can be packaged.

2. A method as defined in claim 1, wherein said packaging sheet material is pulled off at the instant the articles are supplied from where they are stored; and wrapping said sheet material flat around a series of said articles in shape of a U.

3. A method as defined in claim 1, wherein said tube of wrapping material has a U-shaped cross-section; grasping and entraining said tube by conveyor belts rotating at substantially the same speed so that at least one of two arms of the U-shaped tube of wrapping material around said articles and said pushers positioned between said articles is tensioned between and carried along by said pushers and said driving elements acting on said conveyor belts and traveling along with said conveyor belts.

* * * * *